United States Patent [19]

Van Hise

[11] 4,186,420

[45] Jan. 29, 1980

[54] ACCURATE, FAIL-SAFE RELAY TIMER

[75] Inventor: Albert E. Van Hise, Park Ridge, N.J.

[73] Assignee: Otis Elevator Company, New York, N.Y.

[21] Appl. No.: 936,993

[22] Filed: Aug. 25, 1978

[51] Int. Cl.[2] ..... H01H 47/32

[52] U.S. Cl. ..... 361/194; 361/156; 361/196

[58] Field of Search ..... 361/194, 196, 156

[56] References Cited

U.S. PATENT DOCUMENTS

| | | | |
|---|---|---|---|
| 2,958,017 | 10/1960 | Hogue | 361/196 |
| 3,158,790 | 11/1964 | Garratt | 361/1 96 |
| 3,246,209 | 4/1966 | Multari et al. | 361/196 |
| 3,482,148 | 12/1969 | Ingle | 361/196 X |
| 3,934,178 | 1/1976 | Maida | 361/196 |
| 4,137,492 | 1/1979 | Schultz | 361/194 X |

*Primary Examiner*—J D Miller
*Assistant Examiner*—L. C. Schroeder
*Attorney, Agent, or Firm*—M. P. Williams

[57] ABSTRACT

The coil of a relay is activated by a DC voltage directly through a primary switch, which voltage is also applied through a diode to charge a capacitor. A transistor biased by the same DC voltage is connected across the charging diode, but poled for conduction in the opposite direction. When the power is removed from the relay coil and the charging diode, the transistor is forward biased and conducts the charge from the capacitor through the relay to keep the relay energized until such time as the capacitor charge equals the transistor bias; then the transistor cuts off and the relay opens immediately. Relay energization is independent of the transistor; if the transistor fails open, the relay is disenergized instantaneously; if the transistor fails shorted, the relay is deenergized when the capacitor voltage drops below the dropout voltage of the relay; therefore, the circuit is fail safe. Relay dropout as function of transistor cutoff causes the timing to be very accurate; the capacitor charging voltage being the same as the bias supply voltage for the transistor causes the accurate timing to be independent of variations in supply voltage.

3 Claims, 1 Drawing Figure

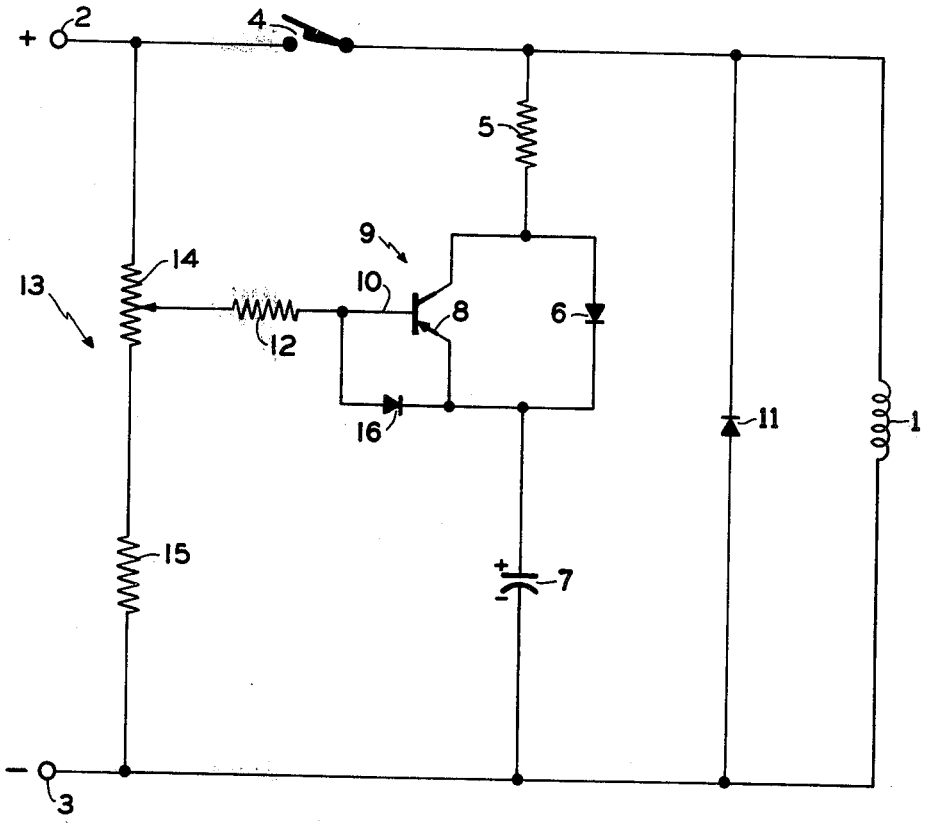
+
2
4
5
9
14
13
10
8
6
12
16
11
1
15
7
−
3

ACCURATE, FAIL-SAFE RELAY TIMER

BACKGROUND OF THE INVENTION

1. Field of Art

This invention relates to relay control circuitry, and more particularly to accurate, fail-safe relay timer circuitry.

2. Description of the Prior Art

It is known that there are many applications where accurate timing of relay operation is required. For instance, in elevator control systems, there are numerous functions controlled by relays which must have relatively accurate timing. In elevator systems, the circuitry must also be fail-safe so as to avoid breakdown of elevator service, or the trapping of or injury to passengers.

Typical relay timing circuitry involves a charged capacitor, the relay resistance, capacitance and relay dropout voltage determining the timing of relay dropout. Additional variable resistance in the RC time constant path, such as a potentiometer, may be utilized to adjust the timing of such a circuit, to overcome variations in relay coil resistance. However, such circuits rely on the decay of voltage below relay dropout voltage to cause disenergizing of the relay; this in turn renders the timing of the circuit dependent upon the particular relay dropout voltage, which may vary widely from one relay to the next. Additionally, since the initial charging voltage is a function of the operating voltage, the time necessary to decay to the relay dropout voltage can vary as a function of operating voltage variations.

Other relay timer circuits may employ a transistor in series with the relay coil. This can provide accurate and rapid turnoff of the relay power, but failure of the transistor in a shorted or open condition forces the relay to be always on or always off, respectively. Since such circuitry frequently has to be in a somewhat hostile environment (such as subject to high acceleration and vibration) the failure incidence is higher than that which can be tolerated in many circumstances. And frequently, failure of such a relay can be hazardous, dependent upon the function which it performs.

SUMMARY OF THE INVENTION

Objects of the invention include provision of relay timer circuitry which is accurate, operable even in case of open circuit or short circuit failures of transistors, and having a time delay characteristic which is essentially independent of variations in operating voltage.

The invention is particularly concerned with time delayed disenergization of a relay coil.

According to the present invention, a relay coil and a capacitor are directly energized through a primary switch means, and the relay coil is disenergized by an auxiliary electronic switch which sustains relay operation with the capacitor charge for an accurately-determined period of time after opening of the primary switch means. According further to the invention, the same operating voltage is used to provide the conduction-determining bias for the auxiliary electronic switch and the charging of the capacitor.

According to the invention in one form, application of operating voltage to a relay coil also applies the voltage to a charging diode to a capacitor. The charging diode is in parallel with a transistor poled to conduct in the opposite direction from the diode. When the operating voltage is removed from the relay and the charging circuit, the transistor becomes forwardly biased with respect to a bias derived from the same operating voltage, thereby applying the capacitor voltage to the relay to sustain operating current, until such time as the capacitor voltage decays to the transistor bias voltage, at which time the transistor ceases to conduct and the relay disenergizes immediately.

The present invention provides accurate timing of relay disenergization which is not only independent of relay dropout voltage, but also substantially independent of power supply variations. The invention also provides fail-safe operation in that a failure of the auxiliary electronic switch in an open circuit condition simply results in immediate dropout of the relay whereas a failure of the auxiliary electronic switch in a short circuit condition will cause the relay to dropout when the capacitor discharges to the dropout voltage of the relay. Thus the circuitry is both extremely accurate and totally fail-safe (insofar as electronic switch operation is concerned). Use of a transistor to open the relay coil line opens the relay quickly, thereby reducing arcing at the contacts of the relay, particularly where high voltage (e.g., 100 V DC) are being controlled thereby.

The foregoing and other objects, features and advantages of the present invention will become more apparent in the light of the following detailed description of an exemplary embodiment thereof, as illustrated in the accompanying drawing.

BRIEF DESCRIPTION OF THE DRAWING

The sole FIGURE herein is a schematic diagram of an exemplary embodiment of the invention.

DETAILED DESCRIPTION

Referring now to the drawing, a relay coil 1 is energized by operating voltage applied across a pair of terminals 2, 3 in response to closure of a primary switch 4. With the switch 4 closed, the operating voltage is also applied to a resistor 5 and a forwardly biased diode 6 to a capacitor 7, the capacitor 7 being also connected to the terminal 3 (which may represent ground or other suitable reference potential). While the relay coil 1 is energized, the capacitor 7 charges to the operating voltage.

When the switch 4 is opened, the emitter 8 of a PNP transistor 9 becomes positive with respect to the base 10 thereof, so the transistor 9 conducts from the capacitor 7 through the resistor 5 and the relay coil 1 to maintain current in the relay coil 1. When the voltage on the capacitor 7 discharges to a level equal (or substantially so) to that of the base 10, the transistor 9 will cease to conduct so that no further current will be supplied to the relay coil 1, and its inductive kick (downward through the coil in the drawing) is conducted through a diode 11.

The bias on the transistor 10 is provided through a resistor 12 from a voltage divider 13 that may consist of a potentiometer 14 and a fixed resistor 15 which supplies a fraction of the operating voltage from the terminal 2 to the base 10 of the transistor 9. Thus the bias at the base 10 is derived from the same operating voltage at the terminal 2 as the maximum voltage which the capacitor 7 can charge to. Therefore, the length of time it takes to discharge the capacitor 7 to a voltage equal to the bias on the base 10 is relatively constant, notwithstanding variations in the operating voltage applied to the capacitor 7. The resistor 15 simply permits more sensitive adjustment of the potentiometer 14.

A diode 16 shunts any reverse voltages across the base-emitter junction of the transistor 9, thereby protecting it against reverse voltage breakdown; similarly, the diode 6 protects the collector-emitter junction from reverse voltage breakdown.

Typical parameters for the disclosed embodiment when used, for instance, in elevator door opening controls, may be

| | |
|---|---|
| Supply Voltage: | +110V DC |
| Potentiometer 14 and Resistor 15: | 100K ohms total |
| Resistor 12: | 270K ohms |
| Resistor 5: | 1K ohms |
| Capacitor 7: | aluminum electrolytic<br>250 ms delay-about 50 microfarods<br>10 sec delay-about 1500 microfarods |
| Transistor 9: | Two SGA-ATES type BC393 (Italy) in Darlington configuration |
| Diodes 6, 11, 17: | 1N5060 |

The circuitry disclosed herein is exemplary, and modifications may be made therein in obvious ways. For instance, if a negative operating voltage is required, an NPN transistor may be substituted for the PNP transistor 9, and the diodes 6 and 17 may be reversed along with the polarity of the capacitor 7 (if the capacitor is an electrolytic or other polarized capacitor). Similarly, if the operating voltage exceeds the voltage rating of readily available high gain transistors, the well known Darlington circuit comprising a pair of PNP transistors in cascade may be utilized in place of the single transistor 9. Similarly, other electronic switch configurations consisting of one or more bipolar or FET transistors may be utilized in any circumstances where warranted.

The circuit of the present invention is independent of relay dropout voltage so long as the relay dropout voltage is lower than the bias voltage at the base 10 of the transistor 9. An important feature of the invention is the fact that the bias voltage is allowed to track the charging voltage of the capacitor, so that as the total voltage charge of the capacitor 7 varies, the bias voltage varies in the same fashion. Therefore, the voltage on the capacitor 7 can decay to the bias voltage in a time interval which is substantially independent of any nominal variation in the operating voltage. Because the transistor is used only as an auxiliary electronic switch to maintain relay current during the delay time interval, and thereafter to shut it off, rather than as a primary switch for energizing the relay coil, the operation is fail-safe with respect to the transistor 9. There is a sneak charging path for the capacitor 7, through the diode 16, the resistor 12 and the potentiometer 14. This path has very high resistance and serves to trickle-charge the capacitor 7 to the bias voltage level, as charge tends to leak off (through reverse-bias impedences) during quiescent operation, and thereby reduces capacitor charging time.

Thus although the invention has been shown and described with respect to an exemplary embodiment thereof, it should be understood by those skilled in the art that the foregoing and various other changes, omissions and additions may be made therein and thereto, without departing from the spirit and the scope of the invention.

Having thus described a typical embodiment of my invention, what I claim as new and desire to secure by Letters Patent is:

1. Relay timer circuitry comprising:

a source of operating voltage;

a relay coil;

a primary switch for selectively connecting said source of voltage to said relay coil for energizing said relay coil;

a capacitor;

a unilaterally conductive charging circuit connecting said capacitor to said switch means for charging said capacitor with said operating voltage when said primary switch is closed; and an auxiliary electronic switch connected in series with said capacitor and said relay coil and poled to conduct current from said capacitor, when it is discharging, through said relay coil, said auxiliary electronic switch being biased to conduct when the voltage across said capacitor exceeds a fraction of said operating voltage.

2. Relay timer circuitry according to claim 1 wherein said auxiliary electronic switch includes a transistor and a voltage divider connected to said operating voltage, said voltage divider providing the fraction of said supply voltage as a bias to the control element of said transistor.

3. Relay timer circuitry according to claim 1 wherein said unilaterally conductive charging circuit includes a diode poled to conduct current from said source of operating voltage to said capacitor in series with a resistor connected to said primary switch, and said auxiliary electronic switch has its main current conducting terminals connected in parallel with said diode in a manner to conduct current through said capacitor and said resistor in a direction opposite to that of current conducted through said diode.

* * * * *